US007306096B2

(12) United States Patent
d'Auriac et al.

(10) Patent No.: US 7,306,096 B2
(45) Date of Patent: Dec. 11, 2007

(54) STORAGE AND DISPLAY CASE FOR WRISTWATCH AND ACCESSORIES

(76) Inventors: Debbie Brooks d'Auriac, 647 S. Mountain Rd., Gardiner, NY (US) 12525; Paul-Philippe d'Auriac, 647 S. Mountain Rd., Gardiner, NY (US) 12525

( * ) Notice: Subject to any disclaimer, the term of this patent is extended or adjusted under 35 U.S.C. 154(b) by 390 days.

(21) Appl. No.: 10/975,613

(22) Filed: Oct. 28, 2004

(65) Prior Publication Data

US 2006/0091027 A1 May 4, 2006

(51) Int. Cl.
*B65D 85/40* (2006.01)

(52) U.S. Cl. ..... 206/301; 206/495; 446/72; 446/98

(58) Field of Classification Search ..... 206/301, 206/495, 477–483, 18, 213, 6.1, 462, 463; D10/31–35; 368/285, 282, 45; 63/21–25; 446/72, 98

See application file for complete search history.

(56) References Cited

U.S. PATENT DOCUMENTS 3,718,260 A * 2/1973 Sharp ..... 211/85.2
3,766,674 A * 10/1973 Bersche ..... 40/113
D339,061 S 9/1993 Kilmartin, III et al.
D365,856 S 1/1996 Rotella
5,547,076 A * 8/1996 Doi et al. ..... 206/301
D373,725 S 9/1996 Weil
5,579,288 A * 11/1996 Malloy et al. ..... 368/10
5,671,849 A * 9/1997 Bacon ..... 211/85.2
D439,158 S 3/2001 Forakis
6,629,677 B2 10/2003 Kirshner

* cited by examiner

*Primary Examiner*—Mickey Yu
*Assistant Examiner*—Steven A. Reynolds

(57) ABSTRACT

The present disclosure is directed to a packaging and display system for a wristwatch. The system includes a support panel, a wristwatch and an accessory, the accessory being capable of augmenting the appearance and enjoyment of the watch. The support panel has a front surface that defines several display locations. A first display location releasably supports a wristwatch in a manner such that a wristband associated with the wristwatch is maintained in a supine position. A second display location releasably supports an accessory, the accessory being adapted and configured to be releasably mounted on a wristband. The front surface also defines indicia for aligning the wristwatch to the first display location and for aligning the accessory to the second display location.

15 Claims, 3 Drawing Sheets

STORAGE AND DISPLAY CASE FOR WRISTWATCH AND ACCESSORIES

BACKGROUND OF THE INVENTION

1. Field of the Invention

The subject disclosure relates to storage and display systems for merchandise, and more specifically to storage and display systems for decorative wristwatches.

2. Background of the Related Art

Point of sale display systems for individual wristwatches and accompanying accessories are known in the art. For instance, U.S. Pat. No. 6,629,677 to Kirshner (the '677 patent) discloses a wristwatch display stand for displaying a wristwatch and a novelty item. The wristwatch is attached to a cuff member. The display stand includes a base that receives both the cuff member and the novelty item.

The '677 patent serves to incorporate a novelty item into a wristwatch display stand, thereby attracting the attention of potential purchasers. However, the watch and the novelty item are generally unrelated and function independently of one another. As such, the novelty item does not accentuate the decorative aspect of the watch itself. Given that many consumers purchase wristwatches based largely, or even solely, on aesthetics, the decorative nature of a wristwatch is an important attribute that is not addressed by the '677 patent. Further, the wristwatch display stand of the '677 patent does nothing to create or promote a relationship between the novelty item and the watch.

It would be beneficial to have a point of sale display system for a wristwatch that can hold a watch and associated accessories so as to accentuate the decorative aspects of the watch. Ideally, the accessories would be capable of augmenting the appearance of the watch, and the display system would promote the relationship between the watch and any such accessories.

In addition to the discussed features, it would be beneficial for the display system to allow the watch to be viewed when not in use. As mentioned, wristwatches are often purchased based on aesthetics, and the appearance of a watch is an important quality. However, while manufacturers expend considerable effort in designing an attractive watch, after sale, its appearance can typically only be appreciated when the watch is worn. When the watch is not in use, it sits on top of a dresser or in a drawer, reducing or eliminating its visibility. As such, the decorative aspect of the watch is only appreciated for limited time.

One concept that gets around these problems is that marketed by The Swatch Group under the tradename Flik Flak Fun Treasures Collection. This product consists of a children's theme watch accompanied by a novelty storage case. The case can be used to store the watch safely and, in some versions, display the watch when not in use. Further, the cases are designed to cooperate with the theme of the watch, and in this regard often have a function other than holding/displaying the watch. For example, a watch depicting various magic tricks comes contained in a "magic box" case that asks the child to decipher a trick to remove the watch.

The interactive nature of the Swatch display case makes the product especially enjoyable for children. Further, the break from traditional packaging helps to promote sales by setting the product apart from competitors at the point of sale. However, the cases of Swatch are complicated and expensive, adding greatly to the total cost of the watch/case system. Further, they must be packaged for sale with the watch, increasing the packaging costs.

It would therefore be beneficial if the manufacturer provided an inexpensive means for displaying the watch at the point of sale, which could then be used to display the watch when it is not in use. Ideally, the system should function cooperatively with the watch to enhance enjoyment of the product, without significantly increasing cost.

SUMMARY OF THE INVENTION

The present disclosure is directed to a packaging and display system for a wristwatch. The system includes a support panel, a wristwatch and an accessory, the accessory being capable of augmenting the appearance and enjoyment of the watch. The system increases the visibility of the watch over the prior art, and incorporates all of the parts into a kit in a way that accentuates any decorative aspects of the watch and promotes the relationship between the panel, watch and accessory. The system is inexpensive to produce, and total product costs are further reduced over prior art by the fact that the system acts as the watch packaging.

The support panel has a front surface, a back surface, a top edge, and a bottom edge. The front surface defines several display locations. A first display location releasably supports a wristwatch in a manner such that a wristband associated with the wristwatch is maintained in a supine position. A second display location releasably supports an accessory, the accessory being adapted and configured to be releasably mounted on a wristband. The front surface also defines indicia for aligning the wristwatch to the first display location and for aligning the accessory to the second display location.

The wristwatch has a watch face and a wristband, the watch face including a depiction of a countenance. The accessory has indicia for aligning the accessory to the second display location, and these indicia also coordinate with the depiction of the countenance on the watch face. The accessory also includes means for releasably engaging the wristband and for releasably engaging the support panel in the second display location. When the accessory engages the support panel, the indicia coordinates with that on the panel; such coordination also occurs between the indicia on the accessory and the countenance on the watch face when the accessory engages the wristband.

In a preferred embodiment, the system includes means at the first and second display locations for releasably engaging the watch and accessory, respectively. Such means, for example, can be a retainer formed integrally with the support panel.

In another preferred embodiment, the system includes means for maintaining the support panel in an upright position in which the top edge is substantially vertically above the bottom edge. Such a configuration of the system increases visibility of the panel, watch, and accessory.

It should be appreciated that the present invention can be implemented and utilized in numerous ways, including without limitation as a process, an apparatus, a system, a device and a method for applications now known and later developed. These and other unique features of the devices disclosed herein will become more readily apparent from the following description and the accompanying drawings.

BRIEF DESCRIPTION OF THE DRAWINGS

So that those having ordinary skill in the art to which the disclosed system appertains will more readily understand how to make and use the same, reference may be had to the drawings wherein.

DETAILED DESCRIPTION OF PREFERRED EMBODIMENTS

Figure 1:
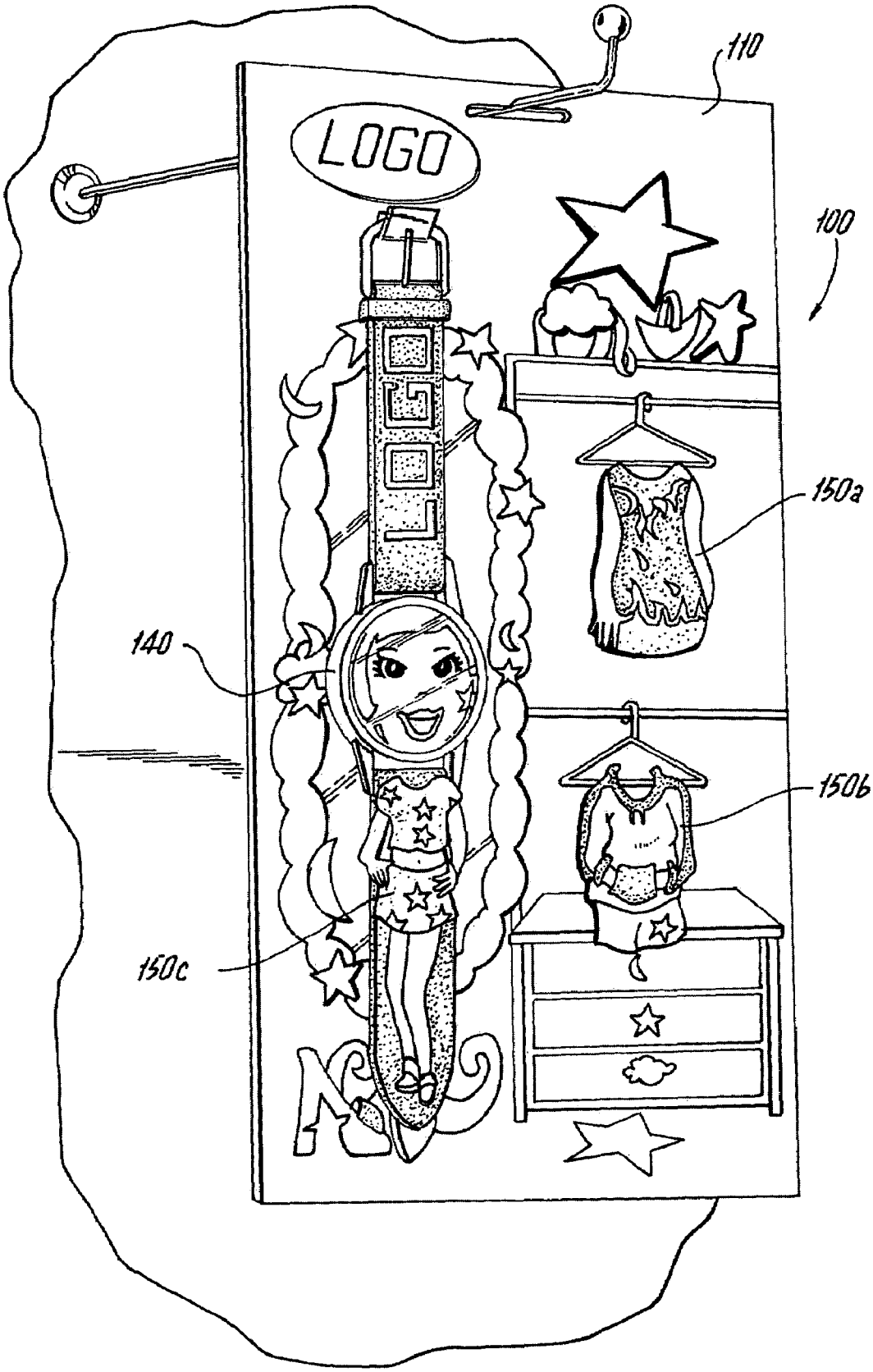
FIG. 1 illustrates a perspective view of a storage and display system for a wristwatch in accordance with the present disclosure, including a support panel, a wristwatch, and several watch accessories, wherein the system is shown suspended from a hook.

Referring now to the drawings, which set forth representative embodiments of the present invention and wherein like reference numerals identify similar structural elements, FIG. 1 shows a system for packaging and displaying a wristwatch, wherein the system is designated generally by the reference numeral 100. System 100 includes a support panel 110, a decorative wristwatch 140, and accessories 150*a-c*. Support panel 110 acts to releasably engage watch 140 and accessories 150*a*, 150*b* in a manner that allows these items to be displayed either in preparation for sale or for post-sale viewing. During use, watch 140 supports accessories 150*a-c*; FIG. 1 shows watch 140 holding accessory 150*c*. The method by which panel 110 releasably engages watch 140 and accessories 150*a*, 150*b* is described in detail later, as is the interaction between watch 140 and accessory 150*c*.

Figure 2:
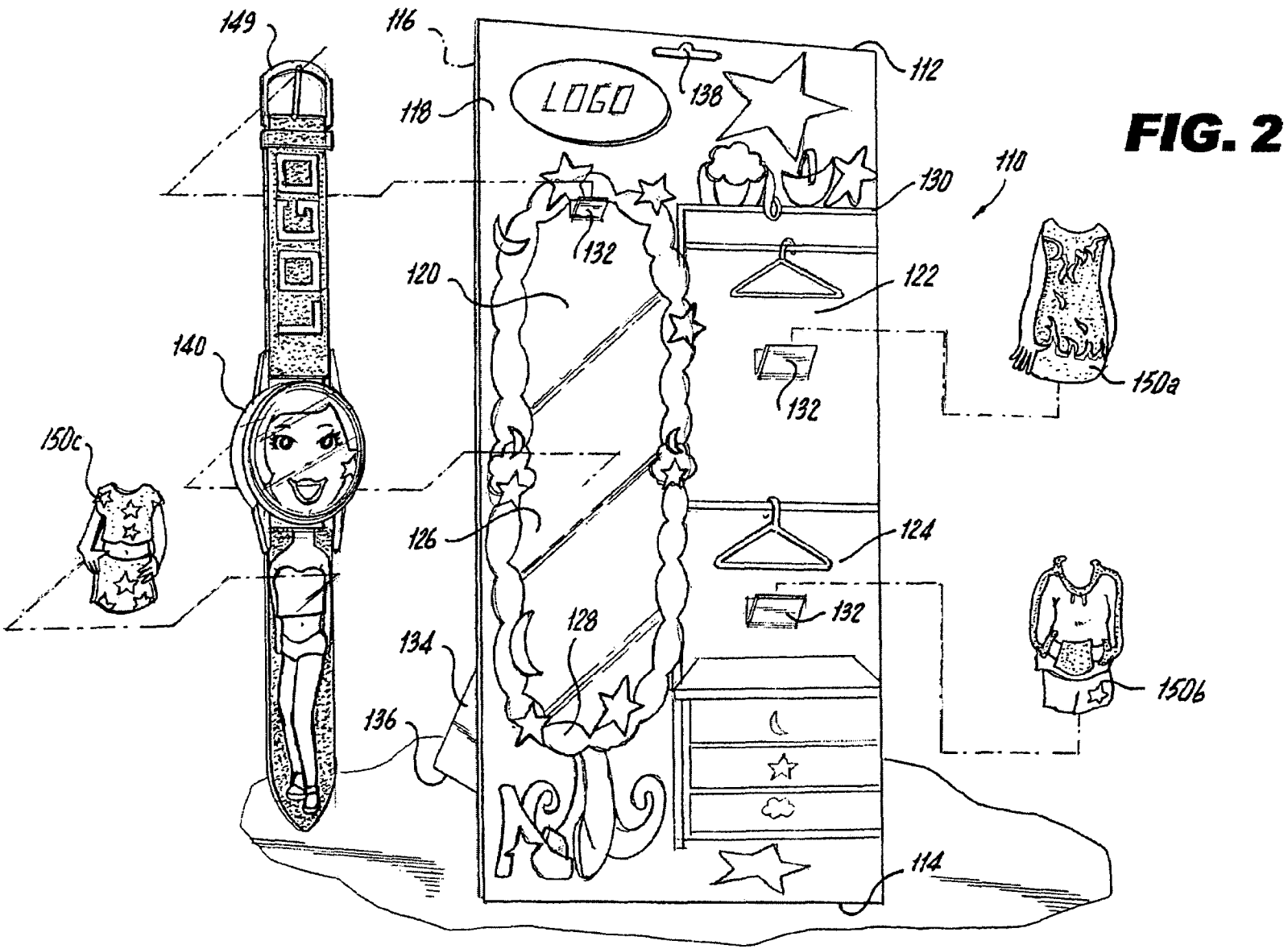
FIG. 2 illustrates a perspective view of a storage and display system of FIG. 1, showing the system as including a support leg and with its parts separated for ease of viewing.

Referring to FIG. 2, support panel 110 is substantially planar with a top edge 112, a bottom edge 114, a back surface 116, and a front surface 118. Front surface 118 defines a first display location 120, a second display location 122, and a third display location 124. Front surface 118 is decorated to have the appearance of a dressing room, and each of the various display locations 120, 122, 124 serves a different function within the dressing room motif. For example, first display location 120 is adorned with a material 126 that has a mirror finish, such as aluminum foil. This mirror-like material 126 is surrounded by a depiction of a mirror frame 128, and, overall, first display location 120 gives the impression of a standing mirror. Further, the second and third display locations 122, 124 include depictions of several compartments of a closet 130. Overall, the display locations 120, 122, 124 act together to give an observer the impression of a dressing room.

Front surface 118 includes a plurality of retainers 132 at the first, second, and third display locations 120, 122, 124 for releasably engaging watch 140 and accessories 150*a-c*. The retainers 132 are preferably formed integrally with panel 110 by perforating panel 110 and folding out the retainers 132. Retainers 132 are adapted and configured such that, when panel 110 is placed in an upright position with top edge 112 vertically above bottom edge 114, retainers 132 project substantially upward. Other shapes and methods of forming the retainers 132 are also possible. For example, retainers can be triangular, as shown, or can be semicircular or rectangular. Retainers can also be formed separately from the panel and subsequently attached by conventional techniques.

Still referring to FIG. 2, a substantially planar support leg 134 is pivotally attached to the back surface 116. Leg 134 can pivot between a collapsed position, in which leg 134 is substantially flat to back surface 116, and an extended position in which leg 134 is situated substantially perpendicularly to back surface 116. Leg 134 has a lower edge 136, and when leg 134 is in the extended position, lower edge 136 and the bottom edge 114 are substantially coplanar. This provides means for maintaining system 100 in the upright position on a horizontal support surface, such as a tabletop, thereby allowing system 100 to be displayed.

Support panel 110 defines an aperture 138 located adjacent to top edge 112. Aperture 138 extends completely through support panel 110, and, as shown in FIG. 1, is adapted and configured to engage a protrusion, such as a nail or a hook, thereby providing means for suspending panel 110 in a display unit for viewing by a customer or in a post-sale environment. Aperture 138 thus provides an additional means for displaying the system 100 and allowing visibility of a watch 140 contained therein.

Figure 3:
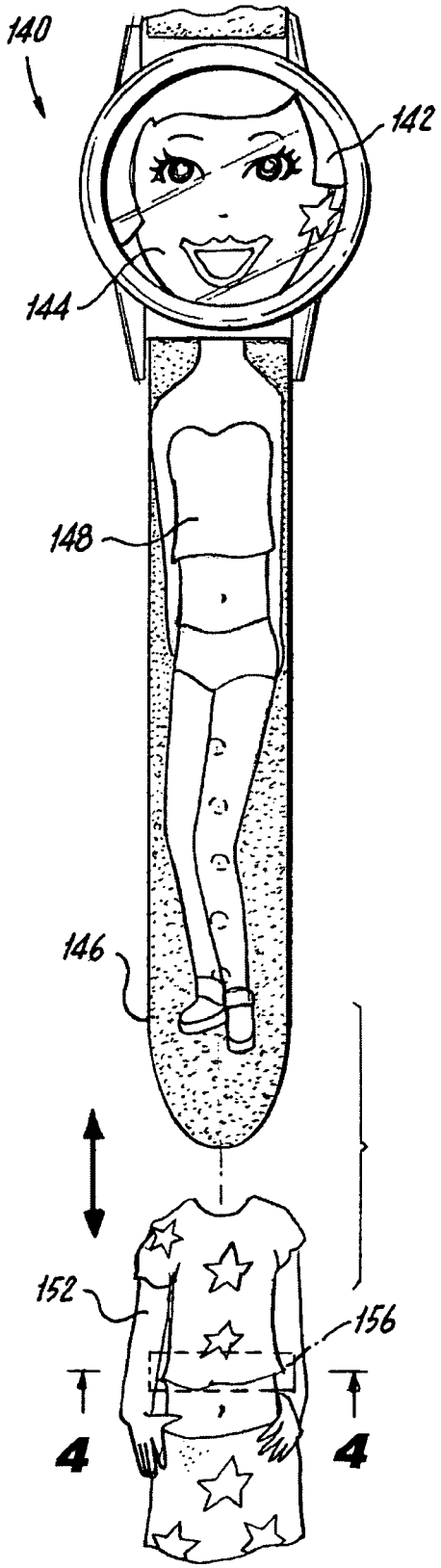
FIG. 3 illustrates a top plan view of a wristwatch and a selected watch accessory for mounting thereon.

As mentioned above, system 100 includes a decorative wristwatch 140, as best seen in FIG. 1. Referring to FIG. 3, wristwatch 140 has a watch face 142 that includes a depiction of a countenance 144. The wristband 146 includes a depiction of a body 148, the body 148 positioned such that it complements the depiction of the countenance 144 in forming a full figure of a person. The depictions 144, 148 present a partially-dressed figure, continuing the dressing room theme of panel 110.

Referring to FIG. 2, wristwatch 140 can be retained at the first display location 120 by placing the clasp 149 of watch 140 over retainer 132. When system 100 is in the upright position, wristwatch 140 hangs on the retainer 132 for display in a supine position with the wristband 146 extended. Retainer 132 allows watch 140 to be removed from system 100 and worn by a user and subsequently replaced to again allow display.

Figure 4:
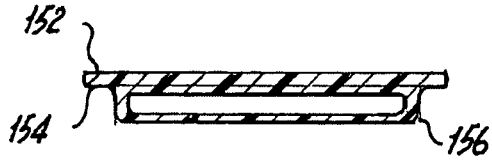
FIG. 4 illustrates a cross sectional view of a watch accessory, the view taken along line 4-4 in FIG. 3 and showing the loop provided on the rear surface of the accessory.
Figure 5:
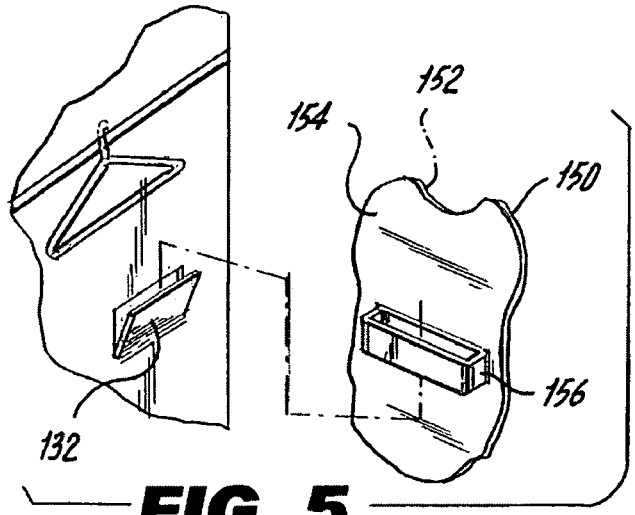
FIG. 5 illustrates a localized perspective view of the second display location of the support panel of FIG. 2, showing one of the hooks on the support panel and the loop on a watch accessory and indicating how these two features engage.

Referring to FIGS. 1, 2, and 5, several watch accessories 150*a-c* are also included in system 100. Watch accessories 150*a-c* can be formed from a variety of materials, including plastics, rubber, and fabric. Each watch accessory 150 has a front surface 152 and a rear surface 154. Front surface 152 includes a depiction of arms and a torso wearing clothes. Rear surface 154 includes a rectangular loop 156 (FIG. 4) for releasably affixing the accessory 150 to one of the display locations 120, 122, 124, or, to wristband 146. Loop 156 can be formed integrally with the accessory 150 or can be formed separately and subsequently attached.

Referring to FIG. 5, to releasably engage accessory 150 in a display location 120, 122, 124, accessory 150 is placed such that loop 156 surrounds retainer 132. The rectangular shape of loop 156 allows accessory 150 to mount securely on retainer 132 without rotating, thereby allowing the depiction on front surface 152 to remain substantially visible at all times when accessory 150 is engaged by retainer 132.

When an accessory 150*a-c* is in either the second or third display locations 122, 124, the depictions on the accessories accord with the dressing room motif of front surface 118 of support panel 110. Specifically, referring to FIG. 1, the clothing depicted on the watch accessories 150*a*, 150*b* appears to hang in the closet 130. In that regard, the ornamentation on the front surfaces 118, 152 of panel 110 and accessories 150*a*, 150*b* acts as indicia for locating accessories 150*a*, 150*b* at the second and third display locations 122, 124, assuring that the imagery of panel 110 and that of accessories 150*a*, 150*b* work together. The same could be said of the ornamentation on watch 140 and panel 110.

Referring to FIG. 1, while accessories 150*a*, 150*b* are engaged by retainers 132 at the second and third display locations 122, 124, accessory 150*c* can be releasably affixed to wristband 146. To do so, wristband 146 is inserted through loop 156, as indicated in FIGS. 3 and 4. Accessory 150*c* slides along wristband 146 until the picture of the clothes on front surface 152 is aligned with the picture of the figure formed by the depictions 144, 148 on watch face 142 and wristband 146. Preferably, wristband 146 has a tapered shape, such that when accessory 150*c* is correctly positioned, friction will hold it in place. As with the combination of accessories 150*a*, 150*b* and panel 110, accessory 150*c* being affixed to watch 140 enhances the imagery of the clothed person and increases the user's enjoyment of the product.

Figure 6:
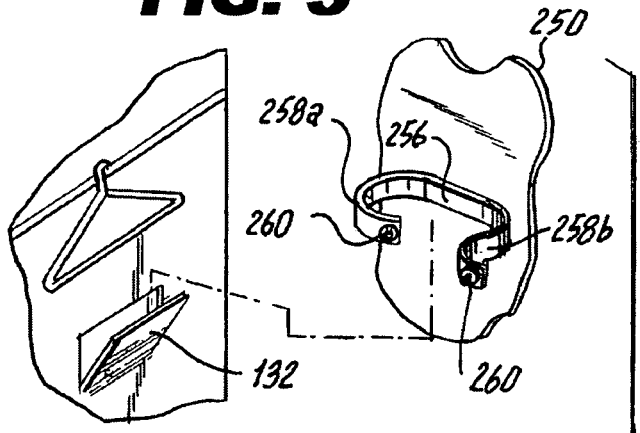
FIG. 6 illustrates a localized perspective view of the second display location of the support panel and an accessory, showing an alternate embodiment of the loop included at the rear surface of the accessory, in which the loop is not continuous and includes a snap closure.
Figure 7:
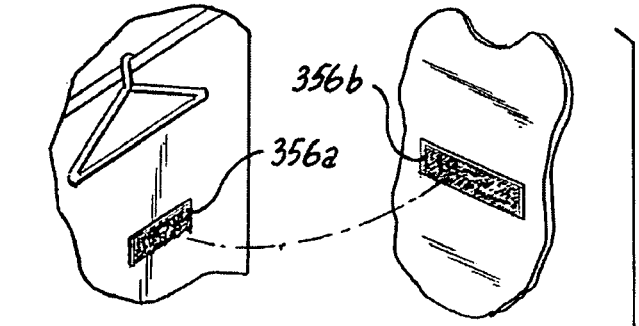
FIG. 7 illustrates a localized perspective view of an alternate embodiment of the second display location of the support panel and of an accessory, showing mating hook-and-loop fastener strips located at the second display location of the support panel and the rear surface of the accessory.

While the accessories 150*a-c* have been described as incorporating a specific loop 156 to facilitate affixing to panel 110 or watch 140, other structures and methods of attachment are possible. For example, referring to FIG. 6, a loop 256 can consist of two separate arms 258*a*, 258*b* that form a continuous loop by securing the arms together with, say, a snap closure 260. When utilizing such a snap closure loop 256, accessory 250 can be attached to wristband 146 by closing loop 256 around wristband 146, making loop 256 just large enough to accommodate wristband 146 so that friction holds accessory 250 in place. In another embodiment, illustrated by FIG. 7, the loop on the accessory and the retainer on the panel are replaced by male and female portions of hook-and-loop fastener strips 356*a*, 356*b*, such as those commercially available under the tradename VELCRO. Wristband attachment is accomplished by including another fastener strip on the wristband 146.

In all, the decorations on front surface 118 of panel 110 give the appearance of a portion of a dressing room, with a mirror and a closet. This allows system 100 to be functional, say, as a component in a dollhouse; this functionality is increased by the inclusion of various methods for allowing system 100 to stand upright. The ability to hold watch 140 in first display location 120 enhances this imagery by giving the appearance of a person using the dressing room, and increases the users enjoyment of the product. Similarly, the ability to releasably affix accessories 150*a-c* in the second and third display locations 122, 124 creates the illusion of clothes hanging in the closet, improving the aesthetic character of the product.

While the invention has been described with respect to preferred embodiments, those skilled in the art will readily appreciate that various changes and/or modifications can be made to the invention without departing from the spirit or scope of the invention as defined by the appended claims. Some examples of possible variations of the previously discussed embodiments are included below.

The system has been described as including a retainer at the first display location, the retainer being used to hold the watch. Alternatively, the watch could be held in the first display location by affixing mating hook-and-loop fastener strips to the support panel and watch. Or, the watch could be secured to the panel by encasing the system in transparent, tight-fitting plastic that leaves the watch visible for sale, but is removed after sale so that the watch is unrestrained.

Alternative means are also envisioned for releasably affixing the watch accessories to either the wristband or the front surface of the panel. For example, the accessories or the panel can include magnets that allow magnetic forces to hold the accessories in place on the panel. In another embodiment, the front surface of the panel and the back surface of the accessories are adapted and configured to allow surface tension to releasably affix the accessories to the panel. Both of the described methods for releasably affixing the accessories to the panel could also be implemented between the watch and accessories.

The panel has been described as being decorated to give an observer the impression of a dressing room. Such decorations can be created directly on the front surface of the panel, or, can be created separately from the panel and releasably attached subsequently. Possible methods for attaching the decorations to the panel include those described above for attaching accessories to the panel. Forming the decorations separately from the panel and allowing for subsequent and releasable attachment allows the user to reconfigure the decorations repeatedly as desired.

Previous embodiments have shown watch accessories attached to the wristband on one side of the watch face. In another embodiment, accessories are attached to the portions of the wristband on both sides of the watch face. This allows, for example, clothes to be positioned on one side of the countenance and a hat on the other. In conjunction with this concept, the support panel could be modified to hold more accessories, and could be decorated to simulate both a closet for hanging clothes and a rack for hanging hats from a wall. Further, while watch accessories have generally been described as including a depiction of clothing on the front surface, the accessories could also form miniature clothing rather than simply depicting the clothes.

In alternative embodiments, the panel need not be planar. For instance, the panel could form a concave shape that gives a stronger impression of a room enclosed by walls. In some embodiments, the panel could be flat, but include flaps that can be bent to form sides. Using either a concave-shaped panel or a panel with flaps, the shape of the panel itself could allow it to stand upright, obviating the need for a support leg.

Finally, the packaging and display system could be used in conjunction with watches for adults rather than children. In that case, the watch would have an appearance that is pleasing to adults. The display stand could sit on a desk or dresser and be available in various colors and styles that match that of the watch. The display stand would thus act as a decorative piece in a room, possibly fulfilling the function of a clock.

What is claimed is:

1. A system for packaging and displaying a wristwatch comprising:

a) a support panel having a front surface, a back surface, a top edge, and a bottom edge, the front surface defining:

i) a first display location for releasably supporting a wristwatch in a manner such that a wristband associated with the wristwatch is maintained in a supine position;

ii) a second display location for releasably supporting an accessory, the accessory being adapted and configured to be releasably mounted on a wristband; and iii) indicia for aligning a wristwatch to be supported in the first display location and for aligning an accessory to be supported in the second display location;

b) a wristwatch releasably supported in the first display location and having a watch face and a wristband, the watch face including a depiction of a countenance; and c) an accessory releasably supported in the second display location and having:

i) indicia for aligning the accessory to the second display location, the indicia coordinating with the depiction of a countenance on the watch face; and ii) means for releasably engaging the wristband and for releasably engaging the support panel in the second display location in a manner such that the indicia on the accessory coordinates with that on the panel and with the countenance on the watch.

2. The system as recited in claim 1, further comprising means for maintaining the support panel in an upright position in which the top edge is substantially vertically above the bottom edge.

3. The system as recited in claim 1, further comprising means for releasably engaging the watch, the means being located at the first display location and coordinating with the indicia defined by the front surface of the support panel.

4. The system as recited in claim 3, wherein the means includes a retainer formed integrally with the support panel.

5. The system as recited in claim 1, further comprising means for releasably engaging the accessory, the means being located at the second display location and coordinating with the indicia defined by the front surface of the support panel.

6. The system as recited in claim 5, wherein the means includes a retainer formed integrally with the support panel.

7. The system as recited in claim 1, wherein the front surface of the support panel further defines a third display location for supporting an accessory.

8. A system for packaging and displaying a wristwatch comprising:

a) a support panel having a front surface, the front surface having:

i) a first display location including means for releasably affixing a wristwatch for display; and ii) a second display location including means for releasably affixing an accessory for display;

b) a wristwatch releasably supported by the support panel in the first display location and having a watch face and a wristband, the watch face including indicial ornamentation;

c) an accessory releasably supported by the support panel in the second display location and including:

i) indicial ornamentation and ii) means for releasably engaging the wristband such that the indicial ornamentation of the accessory is associated with the indicial ornamentation of the watch face;

d) wherein the front surface of the support panel includes indicial ornamentation associated with the indicial ornamentation of the watch face and accessory; and e) wherein the indicial ornamentation of the watch face includes a depiction of a countenance, the indicial ornamentation of the accessory includes a depiction of clothing, and the indicial ornamentation of the front surface of the support panel includes an area with a mirror finish surrounded by a depiction of a mirror frame at the first display location and a depiction of a closet at the second display location.

9. The system as recited in claim 8, wherein the means for releasably affixing the wristwatch maintains the wristband in a supine position.

10. The system as recited in claim 8, wherein the wristband includes a means for engaging the means of the accessory.

11. The system as recited in claim 8, wherein the support panel is substantially planar.

12. The system as recited in claim 8, wherein the wristband includes a depiction of a portion of a body, the depiction sufficient, when combined with the accessory, to complete a picture of a body.

13. The system as recited in claim 8, wherein the accessory includes a representation of a torso and arms.

14. The system as recited in claim 8, wherein the support panel has a back surface adapted to allow the system to stand in a vertical position.

15. The system as recited in claim 8, wherein the support panel is adapted to allow the system to be suspended from a protrusion.

* * * * *